US007004134B2

(12) United States Patent
Higuchi

(10) Patent No.: US 7,004,134 B2
(45) Date of Patent: Feb. 28, 2006

(54) ENGINE GENERATOR

(75) Inventor: Masaaki Higuchi, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 117 days.

(21) Appl. No.: 10/778,889

(22) Filed: Feb. 12, 2004

(65) Prior Publication Data

US 2005/0126529 A1 Jun. 16, 2005

(30) Foreign Application Priority Data

Feb. 17, 2003 (JP) ..... P.2003-038547

(51) Int. Cl.
*F02P 23/00* (2006.01)

(52) U.S. Cl. ..... 123/149 D; 123/143 R; 123/179.29; 123/2; 123/406.56; 123/406.58; 123/559; 123/647; 123/339.18; 290/1 A; 290/46; 290/48; 290/10; 290/38; 60/632

(58) Field of Classification Search ..... 123/149 D, 123/143 R, 647, 179.29, 2, 339.18, 406.56, 123/406.58; 290/10–38, 46–48, 1 A; 310/102 R
See application file for complete search history.

(56) References Cited

U.S. PATENT DOCUMENTS 5,962,939 A * 10/1999 Nakamura et al. ..... 310/70 A
6,661,107 B1 * 12/2003 Higuchi et al. ..... 290/1 A

FOREIGN PATENT DOCUMENTS

| | | |
|---|---|---|
| EP | 0 715 398 A2 | 6/1996 |
| EP | 1 302 637 A2 | 4/2003 |
| JP | 11-200861 A1 | 7/1999 |
| JP | 2002-309953 A1 | 10/2002 |

OTHER PUBLICATIONS

Patent Abstracts of Japan, vol. 1998, No. 12, Oct. 31, 1998, JP 10 201174, Honda Motor Co., Ltd.

* cited by examiner

*Primary Examiner*—Henry Yuen
*Assistant Examiner*—Johnny H. Hoang
(74) *Attorney, Agent, or Firm*—Darby & Darby

(57) ABSTRACT

A positioning pin is knocked onto a crankshaft of an engine and a key way is formed in a boss of a first flywheel. When an outer rotor type generator is connected with the engine, the boss of the first flywheel is fitted over the crankshaft so as to adjust the positioning pin to the key way. When an inner rotor type generator is connected with the engine, a rotor shaft on which a rotor of a generator is mounted is fitted to a second flywheel so as to adjust the positioning pin to a key way formed in the second flywheel. The ignition angle of the engine is determined by fitting the positioning pin to the key way.

2 Claims, 5 Drawing Sheets

ENGINE GENERATOR

BACKGROUND OF THE INVENTION

1. Field of the Invention

The present invention relates to an engine generator capable of driving two kinds of generators, an outer rotor type generator and an inner rotor type generator with a common engine.

2. Discussion of related art

Generally, small utility engines have no external electric power sources like batteries. Many of those engines introduce a flywheel magneto type ignition device. The flywheel magneto type ignition device includes a magnet attached to the outer periphery of a flywheel mounted on a crankshaft and an ignition coil attached to a crankcase in a position opposite to the magnet with a specified gap.

Since the angular position of the magnet with respect to the ignition coil is important in determining the ignition timing of an engine, the crankshaft is key-fitted to the flywheel so as to obtain a specified ignition angle.

In the engine generator incorporating such a small engine, the crankshaft is connected to a rotor of the generator to generate electromotive force on a stator side of the generator by rotating the rotor.

An AVR (Automatic Voltage Regulator) method using a capacitor and the like has been widely introduced for a method of controlling the voltage generated by the generator. However, in recent years, the engine generators are required to have a high precision of the voltage stability and the frequency characteristic. In order to meet the requirements, an inverter method in which the generated voltage is outputted as alternating current having a required frequency after being converted into direct currency, is becoming dominant.

Further, generally, an inner rotor type is widely used in the AVR type generators and an outer rotor type is mainly adopted into the inverter type generators.

Accordingly, hereinafter, the AVR type engine generators will be referred to as a conventional type engine generator and the engine generators using the inverters will be referred to as an inverter type engine generator.

Japanese Patent Application No. Toku-Kai-Hei 11-200861 discloses an inverter type engine generator in which a crankshaft is directly press-fitted to a boss of a flywheel through a woodruff key in a locating condition and the flywheel serves also as an outer rotor.

The conventional type engine generator is inexpensive compared to the inverter type engine generator and are still popular with many users. Therefore, in the assembly line, it is convenient that any type of engine generators, conventional type, inverter type, can be assembled whenever necessary, using common engines and housings.

For example, Japanese Patent Application Laid-open No. Toku-Kai 2002-309953 discloses a technique in which the common use of engines and housings is realized by connecting a flywheel with generators having different control methods through an adapter.

The problem of this technique is that the use of the adapter increases the number of components and inhibits the realization of a compact engine generator due to the elongated length in an axial direction.

Further, there is another problem that since a rotor of the generator is secured to the adapter, an outer rotor can not be adopted and therefore the range of applications is restricted.

Further, in case where the woodruff key is used for locating the angular direction of the flywheel with respect to the crankshaft, since the key extends long in an axial direction, the space for fitting the flywheel over the crankshaft is needed to some extent, this inhibiting the realization of a compactly sized engine generator.

SUMMARY OF THE INVENTION

It is an object of the present invention to provide an engine generator capable of incorporating generators having different control methods on a common engine and a common housing.

In order to attain the object, an engine generator having an engine and a generator connected with the engine through an output shaft of the engine, particularly the engine including an ignition apparatus for producing an ignition angle of the engine by securing an ignition coil to the engine and providing a magnet on an outer periphery of a flywheel at a position corresponding to the ignition angle with respect to the ignition coil, comprises a positioning pin knocked onto the outer periphery of the output shaft for determining the ignition angle of the engine, means for securing an outer rotor to a first flywheel and for fitting a first boss of the first flywheel over the output shaft when an outer rotor type generator is selectively connected with the engine, and for fitting a second boss of a second flywheel over a rotor shaft on which an inner rotor of the generator is mounted and for fitting the rotor shaft over the output shaft and for projecting a rear end of the second boss rearwardly from a rear end of the rotor shaft when an inner rotor type generator is selectively connected with the engine, and means for forming a first key way on an inner periphery surface of the first boss at an angular position to determine the ignition angle of the engine and for fitting the first key way over the positioning pin when the outer rotor type generator is selectively connected with the engine, and for forming a second key way on an inner periphery of a rearwardly projected part of the second boss at an angular position to determine the ignition angle of the engine and for fitting the second key way over the positioning pin when the outer rotor type generator is selectively connected with the engine.

DETAILED DESCRIPTION OF THE PREFERRED EMBODIMENTS

Figure 1:
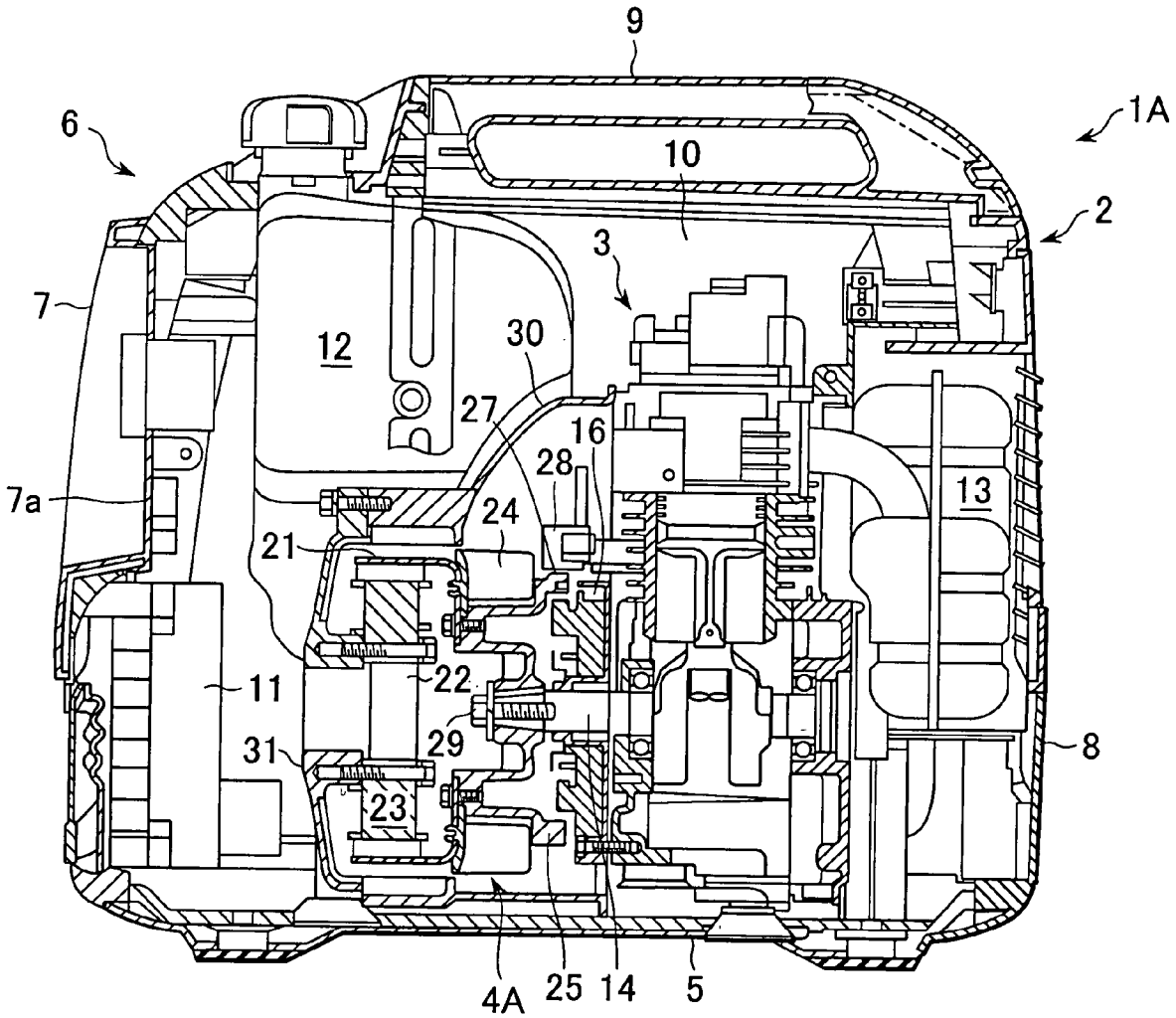
FIG. 1 is a sectional side view of an inverter type engine generator taken along a crankshaft of an engine.

Referring to FIG. 1, reference numeral 1A denotes an inverter type engine generator and reference numeral 2 denotes a housing. The housing 2 comprises a base plate 5 and an insulator cover 6 covering front, rear, left side and right side surfaces.

The insulator cover 6 is divided into two portions, a front cover 7 and a rear cover 8 in a longitudinal direction and these two covers 7, 8 are connected with each other through a handle bar 9 and are connected at the lower parts thereof with the base plate 5. Further, the left and right sides of the insulator cover 6 are closed by a side panel 10, respectively.

A control panel 7*a* and a control unit 11 are disposed on the front cover 7. The control unit 11 is electrically connected with the control panel 7*a* and an inverter type generator 4A. Further, a fuel tank 12 is disposed on a top surface of the front cover 7.

Further, reference numeral 3 denotes a forced air cooling engine mounted on a rear part of the base plate 5. A muffler 13 and an air cleaner (not shown) are disposed behind the engine 3. Further, an output end of a crankshaft 14 forewardly extends from the engine 3. Further, reference numeral 16 denotes a recoil starter.

Figure 2:
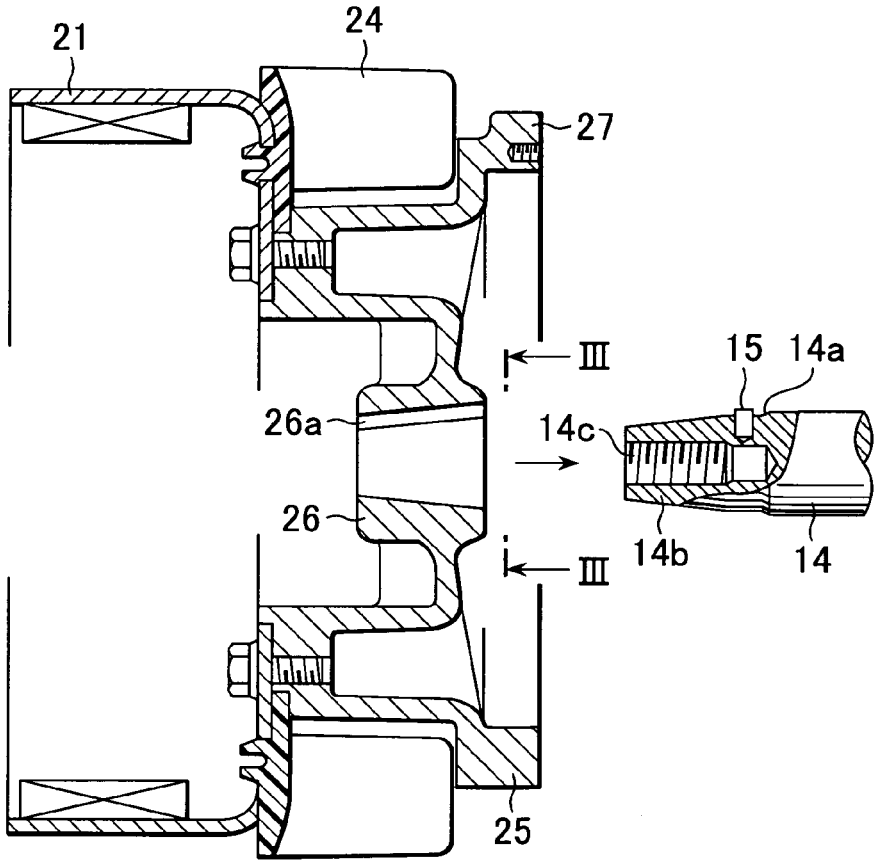
FIG. 2 is a sectional side view of an outer rotor connected to a flywheel taken in an axial direction of a crankshaft of the engine.

Referring to FIG. 2, reference numeral 14*a* is a shoulder section formed at the front end portion of the crankshaft 14. Further, the front end portion of the crankshaft 14 has a taper section 14*b*. Further, a positioning pin 15 is knocked onto the shoulder section 14*a* at an ignition angle position. Further, a tapped hole 14*c* is provided on the center of the front end of the crankshaft 14.

As shown in FIGS. 1, 2, the inverter type generator 4A comprises an outer rotor 21 and a stator 22 coaxially provided on the inner periphery surface side of the outer rotor 21. When the outer rotor 21 rotates around the stator 22, the electromotive force is generated in a coil 23 wound around the stator 22 and the generator 4A generates electricity.

The outer rotor 21 is formed in a cylindrical shape having the opening on the opposite side of the engine 3. A plastic made cooling fan 24 is attached to the rear end surface of the outer rotor 21. Further, the outer rotor 21 is fastened to a first flywheel 25 by bolts. Therefore, the cooling fan 24 is fixed in an interleaving condition between the rear end surface of the outer rotor 21 and the first flywheel 25. Further, a protrusion 27 is formed on the outer periphery of the first flywheel 25 and an ignition timing detecting section 28 is attached to the engine 3 in a position opposing to the protrusion 27 so as to determine the ignition timing by detecting the protrusion 27.

Figure 3:
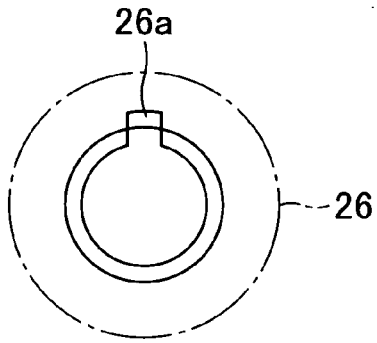
FIG. 3 is a sectional view taken along a line III—III of FIG. 2.

The first flywheel 25 has a first boss 26 in the center thereof and the inner surface of the first boss 26 is shaped into a configuration fitted by the taper section 14*b* of the crankshaft 14. Also, as shown in FIG. 3, the first boss 26 has a key way 26*a* on the inner surface thereof. The key way 26*a* is provided in such an angular position that the protrusion 27 and the detecting section 28 produce a specified ignition timing when the positioning pin 15 is fitted to the key way 26*a*.

As shown in FIG. 1, when the crankshaft 14 is fitted to the first boss 26, the front end surface of the first boss 26 is designed so as to be flush with the front end surface of the crankshaft 14. The outer rotor 21 and the first flywheel 25 are secured to the crankshaft 14 by a bolt 29 screwed to the tapped hole 14*c*.

Further, the stator 22 is fixed to a housing 31 secured to a fan cover 30 for peripherally covering the fist flywheel 25 and the cooling fan 24. The open end of the fan cover 30 is secured to the engine 3.

Figure 4:
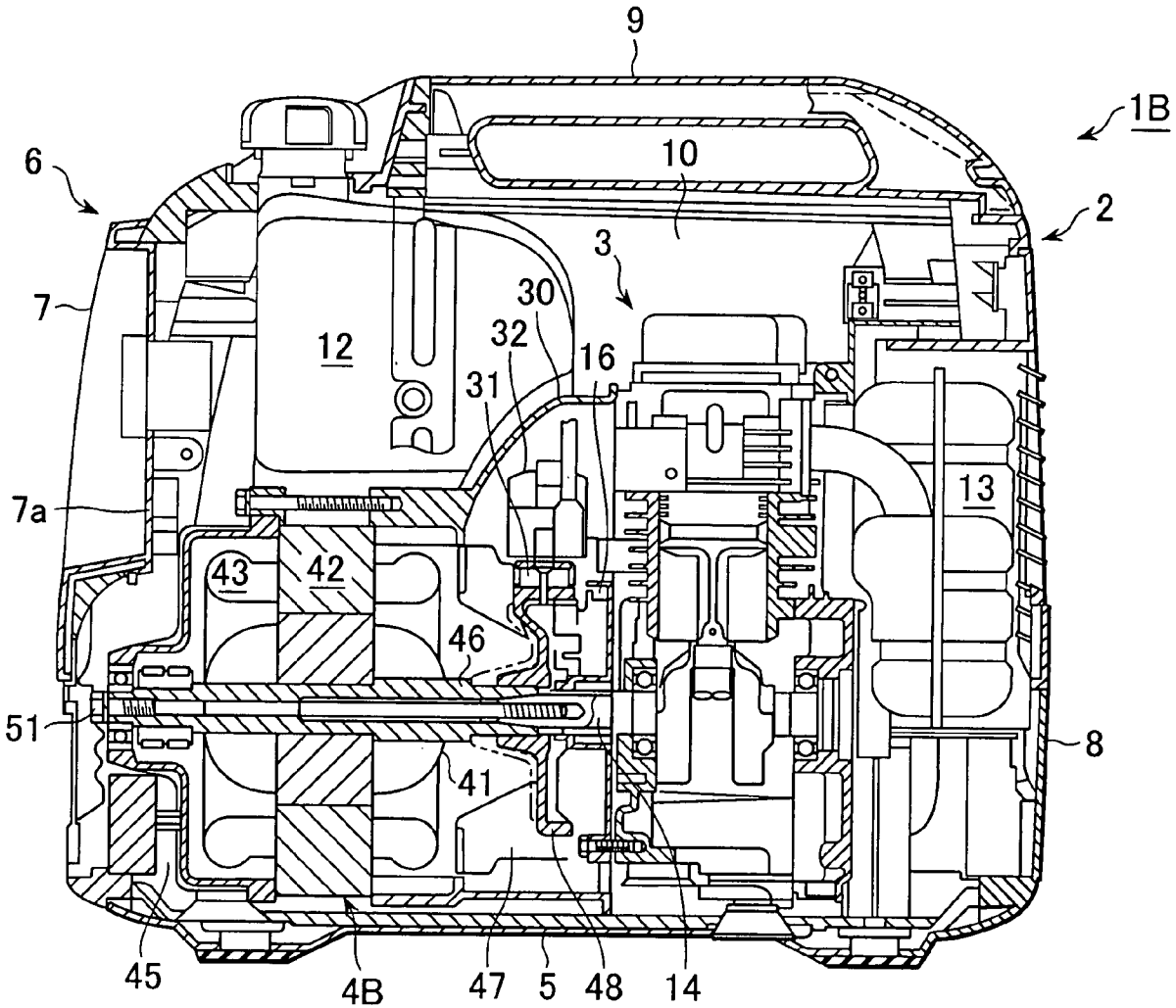
FIG. 4 is a sectional side view of a conventional type engine generator taken in an axial direction of a crankshaft of an engine.

Referring to FIG. 4, reference numeral 1B denotes a conventional type engine generator. As described before, the conventional type engine generator 1B has the housing 2 and the engine 3 in common with the inverter type engine generator 1A. Accordingly, the description of the conventional type engine generator 1B is focused on an AVR type generator 4B and other peripheral components. Identical components to both are denoted by identical reference numerals and the description of those will be omitted.

Figure 5:
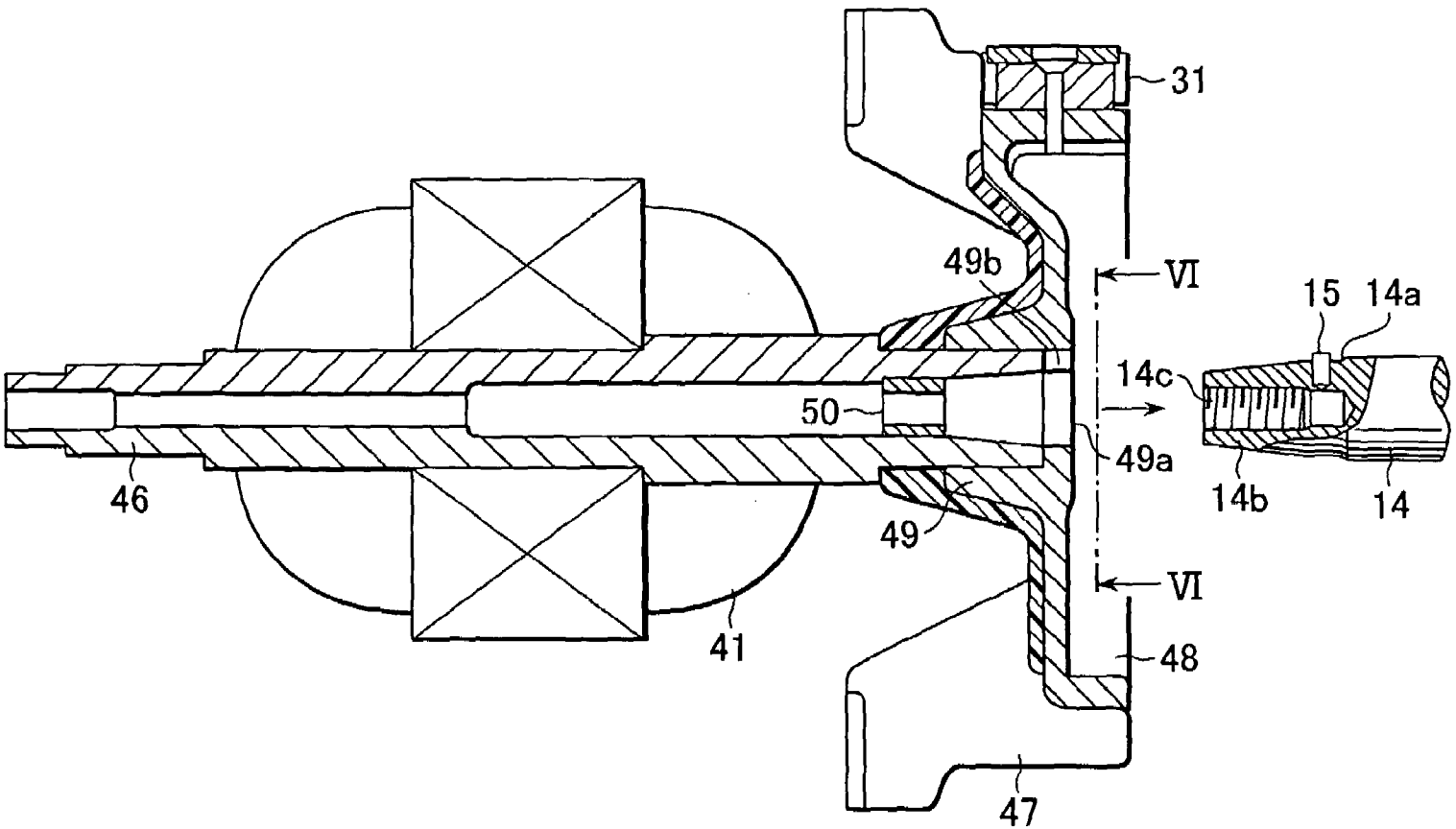
FIG. 5 is a sectional view of an inner rotor connected to a flywheel taken in an axial direction of a crankshaft of the engine.

Reference numeral 42 denotes a stator which is fixed in an interleaving condition between the fan cover 30 and a housing 45. Further, reference numeral 41 denotes an inner rotor and reference numeral 46 denotes a rotor shaft whose front end is rotatably supported by the housing 45. Further, as shown in FIG. 5, a plastic made cooling fan 47 and a second boss 49 of a second flywheel 48 are press-fitted over the rear end of the rotor shaft 46 in this order. Further, a magnet 31 constituting a flywheel magneto is secured to the outer periphery surface of the second flywheel 48. On the other hand, an ignition coil 32 is attached to the engine 3 with a specified gap in an opposite position to the magnet 31.

Further, as shown in FIG. 5, the second boss 49 has a bore section 49*a* at the rear end thereof. The bore section 49*a* is fitted over the shoulder section 14*a* formed on the crankshaft 14. Further, a key way 49*b* for guiding the positioning pin 15 is formed in an axial direction on the inner surface of the bore section 49*a*. The positional relationship between the key way 49*b* and the positioning pin 15 agrees with the ignition angle formed by the magnet 31 and the ignition coil 32.

Further, the rear end surface of the rotor shaft 46 is flush with the end surface of the bore section 49*a* and the inner periphery surface of the rotor shaft 46 is shaped so as to be press-fitted over the taper section 14*b*. As shown in FIG. 4, the rotor shaft 46 is connected to the crankshaft 14 by a through bolt 51 screwed into the tapped hole 14*c*. Further, a stopper ring 50 is fitted to the inner periphery of the rotor shaft 46 to determine the amount of press-fitting of the crankshaft 14 to the rotor shaft 46.

Next, an operation of this embodiment will be described.

According to the embodiment, two different types of generators 4A, 4B can be connected with a common engine 1 through respective flywheels 25, 48 having different configurations and thus constituted combinations of the engine 1 and the generators 4A, 4B can be accommodated in a common housing 2.

That is, as shown in FIG. 2, in case of the inverter type generator 4A, the first flywheel 25 is connected with the rear end of the outer rotor 21 and the inner surface of the boss 26 of the first flywheel 25 is shaped so as to be fitted over the taper section 14*b*. Further, the key way 26*a* is formed so as to be fitted over the positioning pin 15 knocked onto the shoulder section 14*a* of the crankshaft 14.

On the other hand, as shown in FIG. 5, in case of the AVR type generator 4B, the boss 49 of the second flywheel 48 is press-fitted over the rear end of the rotor shaft 46 for supporting the inner rotor 41 and the rear end surface of the bore section 49*a* formed in the boss 49 is positioned so as to agree with the rear end surface of the rotor shaft 46. Therefore, the boss 49 is protruded rearwardly from the rear end surface of the rotor shaft 46 by the thickness of the bore section 49*a*. The key way 49*b* is formed in the bore section 49*a* so as to be fitted over the positioning pin 15 knocked onto the shoulder section 14*a* of the crankshaft 14.

Figure 6:
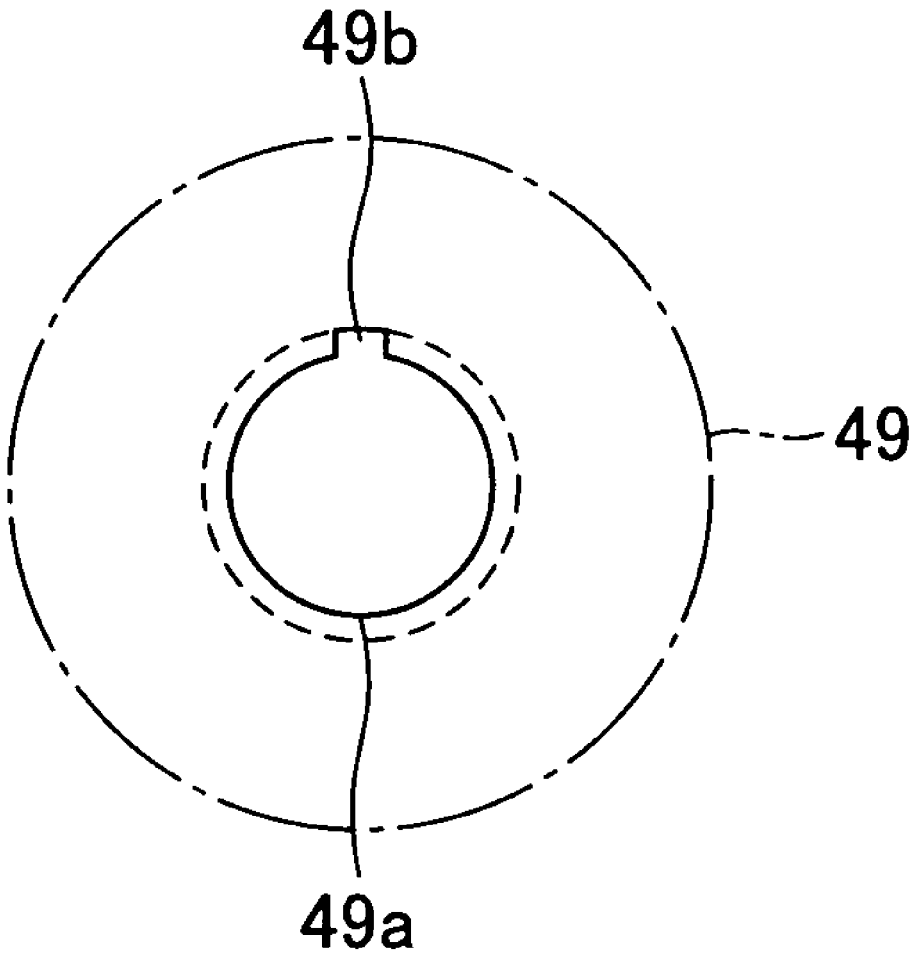
FIG. 6 is a sectional view taken along a line IV—IV of FIG. 5.

The key ways 26*a*, 49*b* (refer to FIG. 3, FIG. 6) formed in the bosses 26, 48 of both flywheels 25, 48 and the positioning pin 15 knocked onto the crankshaft 14 are provided in an angular position corresponding to that of the detecting section 28 and the ignition coil 32, respectively. Thus, the ignition angle formed by the protrusion 27 and the detecting section 28 and the ignition angle formed by the magnet 31 and the ignition coil 32 can be determined by press-fitting the bosses 26, 49 of the flywheels 25, 48 over the crankshaft 14 and by fitting the key ways 26*a*, 49*b* over the positioning pin 15 knocked onto the crankshaft 14, respectively.

Next, a brief explanation of the assembling processes will be made.

When the inverter type generator 4A is connected to the engine 1, the first boss 26 secured to the outer rotor 21 of the generator 4A of the first flywheel 25 is press-fitted over the taper section 14*b* of the crankshaft 14 and the key way 26*a* formed on the inner periphery of the boss 26 is fitted over the positioning pin 15 knocked onto the crankshaft 14. Then, the front end surface of the first boss 26 is flush with the front end surface of the crankshaft 14.

After that, the bolt 29 is screwed into the tapped hole 14*c* tapped through the center axis of the crankshaft 14 and as a result the first flywheel 25 and the outer rotor 21 secured on the flywheel 25 are connected to the crankshaft 14.

When the engine 1 starts and the crankshaft 14 rotates, since the boss 26 of the flywheel 25 is press-fitted overt the taper section 14*b* of the crankshaft 14, the rotating force is transmitted to the flywheel 25 through the press-fitting portion and transmitted from the flywheel 25 to the outer rotor 21.

In this case, since the transmission of power is performed in the taper section 14*b* of the crankshaft 14, there is no transmission of power between the key way 26*a* and the positioning pin 15. Accordingly, even in case where the positioning pin 15 is fitted to the key way 26*a* in a linear contact condition, the positioning pin 15 or the key way 26*a* is not damaged. As a result, a standard part may be used for the positioning pin 15.

On the other hand, when the AVR type generator 4B is connected to the engine 1, as shown in FIGS. 4 and 5, the rear end of the rotor shaft 46 is press-fitted over the taper section 14*b* of the crankshaft 14. At the same time, the key way 49*b* formed at the bore section 49*a* of the second boss 49 of the second flywheel 48 is fitted over the positioning pin 15 knocked onto the crankshaft 14. Then, the front end surface of the crankshaft 14 abuts against the stopper ring 50 fitted to the rear end of the rotor shaft 46 and as a result the axial positioning of the rotor shaft 46 with respect to the crankshaft 14 is determined.

After that, as shown in FIG. 4, the front end of the rotor shaft 46 is rotatably supported by the housing 45 fastened to the fan cover 30 through the stator 42. The one end of the fan cover 30 is secured to the engine 1. The rotor shaft 46 is connected with the crankshaft 14 by screwing the through bolt 51 into the tapped hole 14*c* tapped on the crankshaft 14.

When the engine starts and the crankshaft 14 rotates, since the rear end of the rotor shaft 46 is press-fitted overt the taper section 14*b* of the crankshaft 14, the rotating force is transmitted to the inner rotor 41 through the press-fitting portion.

In this case, since the transmission of power is performed in the taper section 14*b* of the crankshaft 14, there is no transmission of power between the key way 49*b* and the positioning pin 15. Accordingly, even in case where the positioning pin 15 is fitted to the key way 49*b* in a linear contact condition, the positioning pin 15 and the key way 49*b* is not damaged.

Further, since the diameter of the positioning pin 15 is smaller than the longitudinal length of a woodruff key, the longitudinal or axial length of the key way 49*b* can be shortened and as a result the thickness of the bore section 49*a* formed in the second boss 49 can be reduced. The reduction of the thickness of the bore section 49*a* provides the AVR generator 4B with a shorter axial size.

Thus, according to the embodiment, since the common engine can be connected with different generators having different control methods in the assembly line whenever necessary, the productivity of the engine generators enhances and the manufacturing cost of products can be reduced.

Further, according to the embodiment, since the positioning pin 15 having a small diameter is employed in place of the woodruff key having a long lengthwise length, the longitudinal length of the engine generators can be reduced.

The entire contents of Japanese Patent Application No. Tokugan 2003-038547 filed Feb. 17, 2003, is incorporated herein by reference.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments which can be embodied without departing from the principle of the invention set out in the appended claims.

What is claimed is:

1. An engine generator having an engine and a generator connected with said engine through an output shaft of said engine, said engine including an ignition apparatus for producing an ignition angle of said engine by securing an ignition coil to said engine and providing a magnet on an outer periphery of a flywheel at a position corresponding to said ignition angle with respect to said ignition coil, comprising:

a positioning pin knocked onto said outer periphery of said output shaft for determining said ignition angle of said engine;

means for securing an outer rotor to a first flywheel and for fitting a first boss of said first flywheel over said output shaft when an outer rotor type generator is selectively connected with said engine, and for fitting a second boss of a second flywheel over a rotor shaft on which an inner rotor of said generator is mounted and for fitting said rotor shaft over said output shaft and for projecting a rear end of said second boss rearwardly from a rear end of said rotor shaft when an inner rotor type generator is selectively connected with said engine; and means for forming a first key way on an inner periphery surface of said first boss at an angular position to determine said ignition angle of said engine and for fitting said first key way over said positioning pin when said outer rotor type generator is selectively connected with said engine, and for forming a second key way on an inner periphery surface of a rearwardly projected part of said second boss at an angular position to determine said ignition angle of said engine and for fitting said second key way over said positioning pin when said outer rotor type generator is selectively connected with said engine.

2. The engine generator according to claim 1, wherein said ignition apparatus is constituted by a protrusion provided on an outer periphery of said flywheel and a detecting section secured to said engine for detecting an angular position of said protrusion.

* * * * *